US005526430A

United States Patent [19]

Ono et al.

[11] Patent Number: 5,526,430

[45] Date of Patent: Jun. 11, 1996

[54] PRESSURE GRADIENT TYPE MICROPHONE APPARATUS WITH ACOUSTIC TERMINALS PROVIDED BY ACOUSTIC PASSAGES

[75] Inventors: Kiminori Ono, Katano; Satoru Ibaraki, Higashioosaka; Yuji Yamashina, Takatsuki, all of Japan

[73] Assignee: Matsushita Electric Industrial Co., Ltd., Osaka, Japan

[21] Appl. No.: 283,912

[22] Filed: Aug. 3, 1994

[51] Int. Cl.[6] ..... H04R 5/00

[52] U.S. Cl. ..... 381/26; 381/91

[58] Field of Search ..... 381/26, 91, 169

[56] References Cited

U.S. PATENT DOCUMENTS 4,070,547 1/1978 Dellar ..... 381/26

4,633,498 12/1986 Warnke et al. ..... 381/26

4,819,270 4/1989 Lombardo ..... 381/26

4,836,326 6/1989 Wehner et al. ..... 381/91

*Primary Examiner*—Stephen Brinich

*Attorney, Agent, or Firm*—Wenderoth, Lind & Ponack

[57] ABSTRACT

In a small-sized pressure gradient type microphone apparatus, a plurality of omni-directional microphone units are encased within a microphone holder. A plurality of acoustic passages having first and second ends are provided within the microphone holder for coupling the sound inlets of the plurality of omni-directional microphone units respectively to an outer space of the microphone holder. The second ends of the acoustic passages opened to the outer space of the microphone holder are arranged to be apart from each other at distances larger than distances between the sound inlets of the corresponding microphone units coupled at the first ends of the acoustic passages.

3 Claims, 6 Drawing Sheets

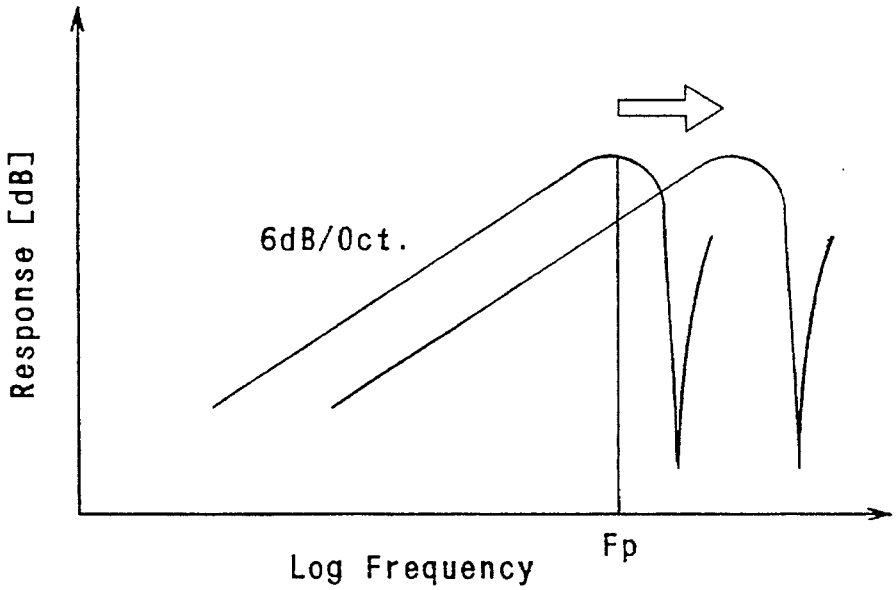
Fig. 4
Fig. 5
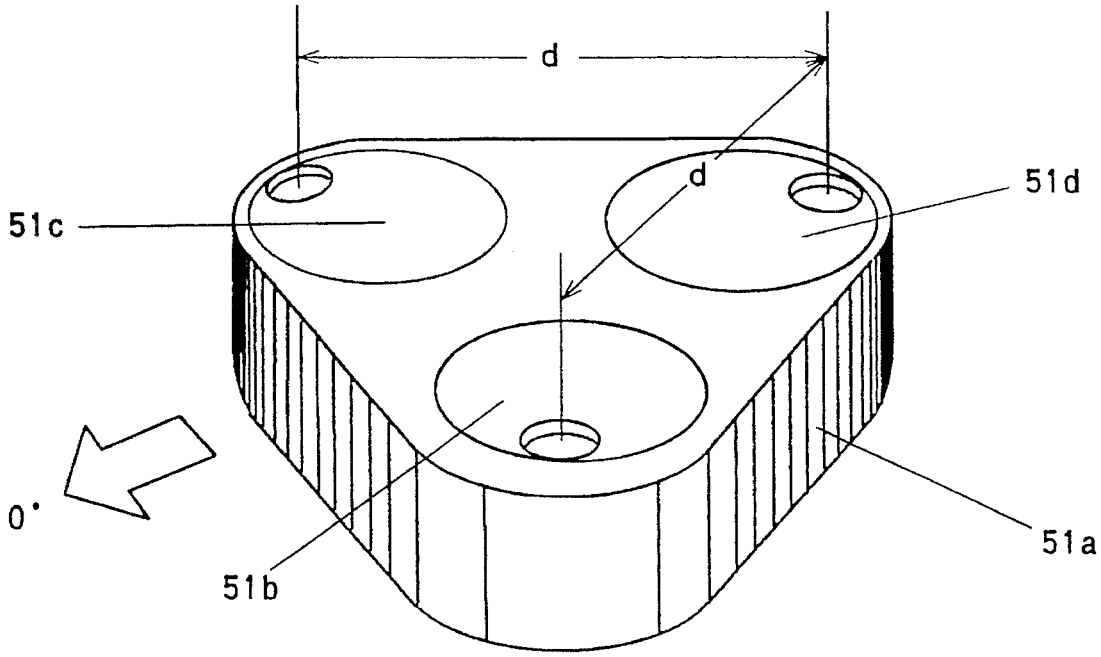

PRESSURE GRADIENT TYPE MICROPHONE APPARATUS WITH ACOUSTIC TERMINALS PROVIDED BY ACOUSTIC PASSAGES

BACKGROUND OF THE INVENTION

1. Field of the Invention

The present invention relates to a microphone apparatus for use in a small-size recording apparatus having an audio recording function, and more particularly to a pressure gradient type microphone apparatus having a plurality of omni-directional microphone units.

2. Description of the Prior Art

Video cameras are widely known as small-size recording apparatus having an audio recording function. Particularly, consumer-use video cameras have been remarkably reduced in size. Installation of the microphone apparatus in such small-sized consumer-use video cameras has changed from the type in which the microphone apparatus is mounted outside of the camera body to the type in which the microphone apparatus is encased in an inner space within a part of the camera body. The so-called pressure-gradient type microphone apparatus having a plurality of omni-directional microphone units has been widely used as such an encased microphone apparatus. The pressure-gradient type microphone apparatus comprises a plurality of omni-directional microphone units arranged on an outer horizontal surface of the camera body, and a directivity forming circuit for processing output signals of the plurality of microphone units. The pressure-gradient type microphone apparatus generally has the following advantages:

1) The microphone units are less affected by reflection and diffraction from the camera body, so that good sound-pickup characteristics can be obtained.

2) The directivity can be changed easily.

However, the sensitivity to sound pressure of the pressure gradient type microphone apparatus is proportional to the distance between the microphone units (the distance between the centers of the sound inlets of the microphone units), i.e., the distance between acoustic terminals of the microphone units. That is, the reduction in overall size of the microphone apparatus inherently sacrifices the sensitivity to sound pressure. Accordingly, it has been difficult to largely reduce the overall size of the conventional pressure gradient type microphone apparatus while maintaining a practically required sensitivity to sound pressure.

SUMMARY OF THE INVENTION

Accordingly, it is an object of the present invention to provide a pressure gradient type microphone apparatus which can be remarkably reduced in size while maintaining a practically required sensitivity to sound pressure and thus can be mounted in a reduced installation space in a recording apparatus.

To achieve this object, a pressure gradient type microphone apparatus according to the present invention comprises: a plurality of omni-directional microphone units, each of the plurality of microphone units having a diaphragm provided perpendicularly to an axial direction of the unit and a sound inlet for exposing therethrough the diaphragm; a microphone holder for encasing therein the plurality of omni-directional microphone units which are arranged in parallel in the axial direction so that the diaphragms direct in a same direction; and a plurality of acoustic passages, or pipes, provided within the microphone holder and having first ends which are respectively coupled to the sound inlets of the plurality of omni-directional microphone units and having second ends which are opened to an outer space of the microphone holder for coupling the sound inlets of the plurality of omni-directional microphone units to the outer space of the microphone holder respectively by the plurality of acoustic passages. The second ends of the acoustic passages are arranged to be apart from each other at distances larger than distances between the sound inlets of the corresponding microphone units coupled at the first ends of the acoustic passages.

Distances between acoustic terminals of this pressure gradient type microphone apparatus are determined by the distances between the open ends of the acoustic passages provided in the microphone holder. That is, the distances between the acoustic terminals, or the sensitivity to sound pressure, can be maintained while reducing the distances between the microphone units, or reducing the size of the microphone apparatus.

BRIEF DESCRIPTION OF THE DRAWINGS

FIG. 4 is a frequency response diagram showing a sensitivity to sound pressure in the front direction of the conventional first-order pressure gradient type microphone apparatus;

FIG. 5 is a schematic perspective view of a microphone apparatus according to another embodiment of the present invention;

DESCRIPTION OF THE PREFERRED EMBODIMENTS

Figure 1A:
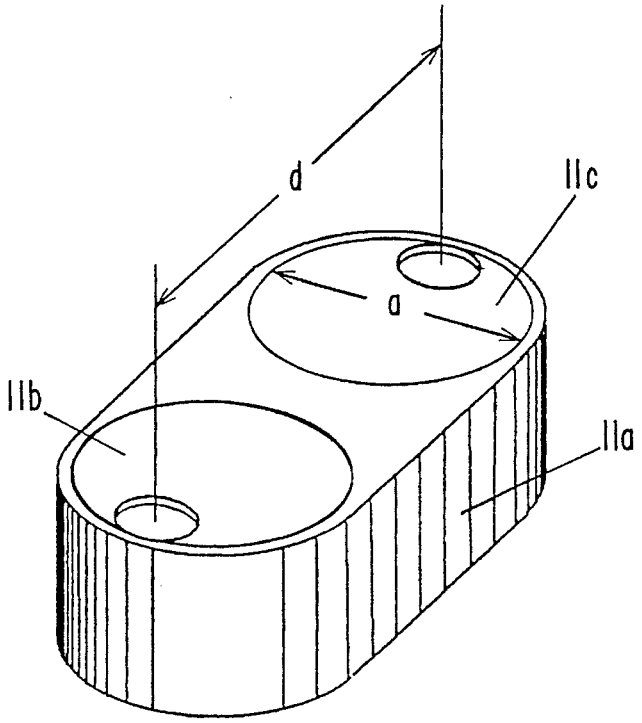
FIG. 1*a* is a schematic perspective view of a microphone apparatus according to an embodiment of the present invention.
Figure 1B:
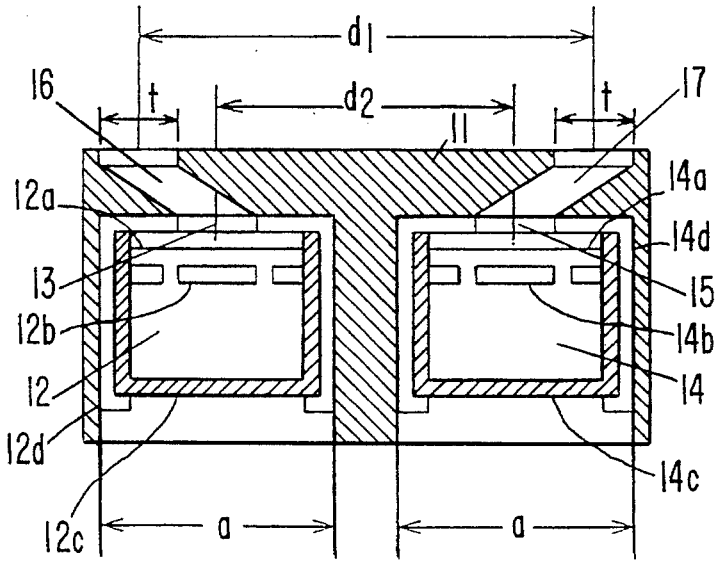
FIG. 1*b* is a cross sectional view of the microphone apparatus shown in FIG. 1*a;*

FIG. 1*a* is a schematic perspective view of a microphone apparatus according to an embodiment of the present invention, and FIG. 1*b* is a cross sectional view of the microphone apparatus shown in FIG. 1*a*. A microphone holder 11*a* comprises a pair of unit holders 11*b* and 11*c* holding therein two omni-directional microphone units 12 and 14 respectively. The omni-directional microphone 12 comprises a diaphragm 12*a* and a back plate 12*b* which are mounted parallel to each other in an inner casing 12*c* to constitute a parallel plane capacitor, and an outer casing 12*d* encasing therein the inner casing 12*c*. The outer casing 12*d* has a sound inlet 13 provided at a center of a front surface thereof opposing the diaphragm 12*a* to expose therethrough the diaphragm 12*a*. Similarly, the other omni-directional microphone 14 comprises a diaphragm 14*a*, a back plate 14*b*, an inner casing 14*c*, and an outer casing 14*d*. The two microphone units 12 and 14 are inserted into the unit holders 11*b* and 11*c* from the front ends of the outer casings 12*d* and 14*d* at which the sound inlets 13 and 15 are provided. The outer casing 14*d* has a sound inlet 15 provided at a center of a front surface thereof to expose therethrough the diaphragm 14*a*. Two passages, or pipes, 16 and 17 are provided in the holder 11*a* for acoustically coupling the sound inlets 13 and 15 respectively to the open space (front open space) outside the holder 11*a*. The acoustic passage 16 has opposite ends, one end being connected to the sound inlet 13 of the microphone unit 12 and the other, open end being opened to the front outer space of the holder 11*a*. Similarly, the acoustic passage 17 has opposite ends, one end being connected to the sound inlet 15 of the microphone unit 14 and the other, open end being opened to the front outer space of the microphone holder 11*a*. The two passages (pipes) 16 and 17 are arranged such that the distance $d_1$ between centers of the open ends of the acoustic passages 16 and 17 is larger than the distance $d_2$ between centers of the sound inlets 13 and 15 of the microphone units 12 and 14.

Figure 7:
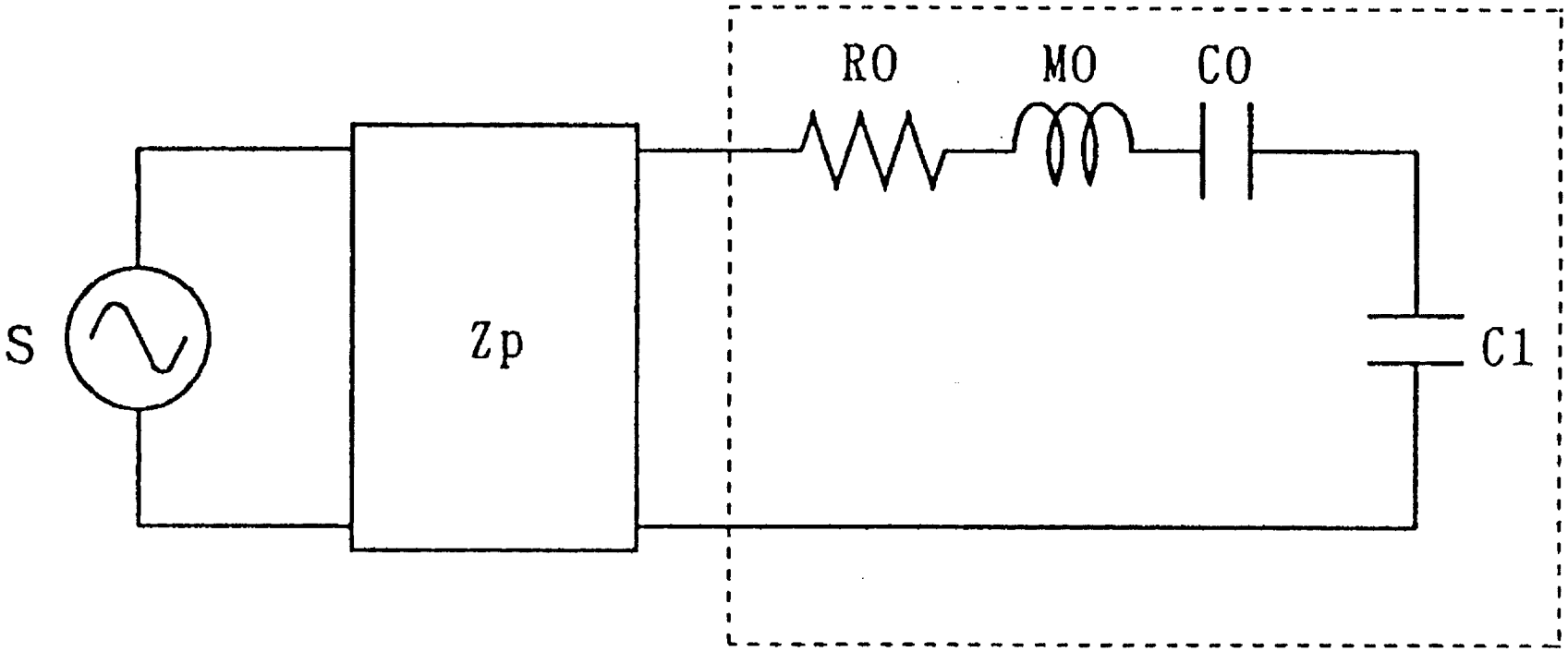
FIG. 7 is an equivalent circuit diagram of an acoustic system consisting of an omni-directional microphone unit and an acoustic passage coupled to the microphone unit.
Figure 8:
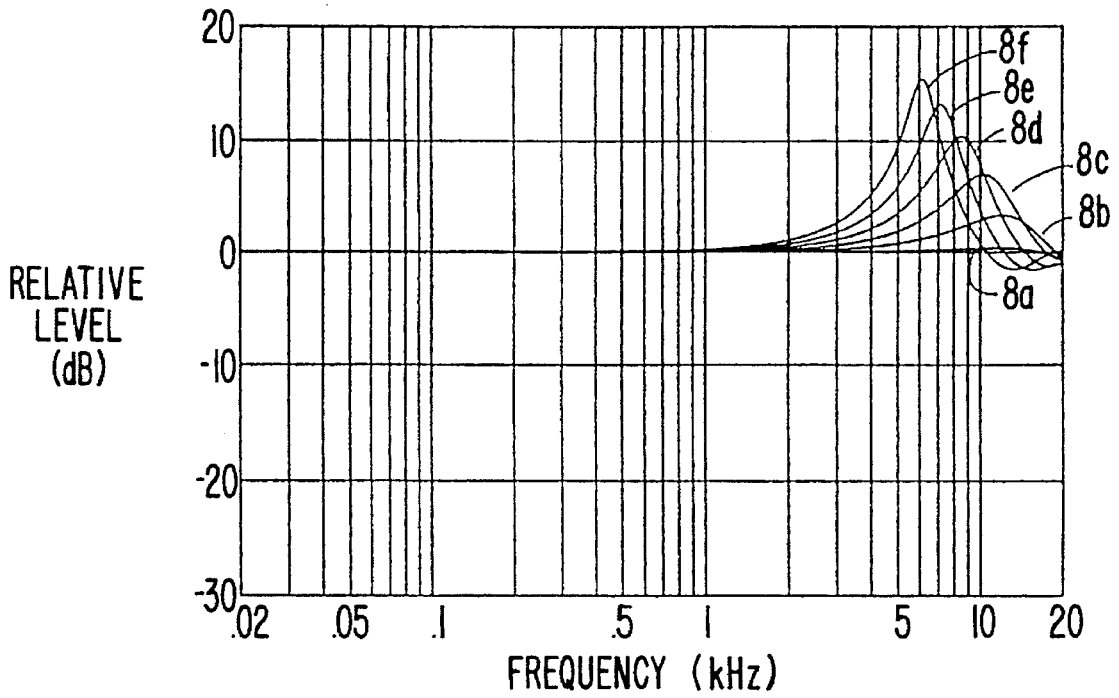
FIGS. 8 a diagram showing a change of a frequency characteristic of the output of the microphone unit dependent on the length of the acoustic passage in the system shown in FIG. 7.
Figure 9:
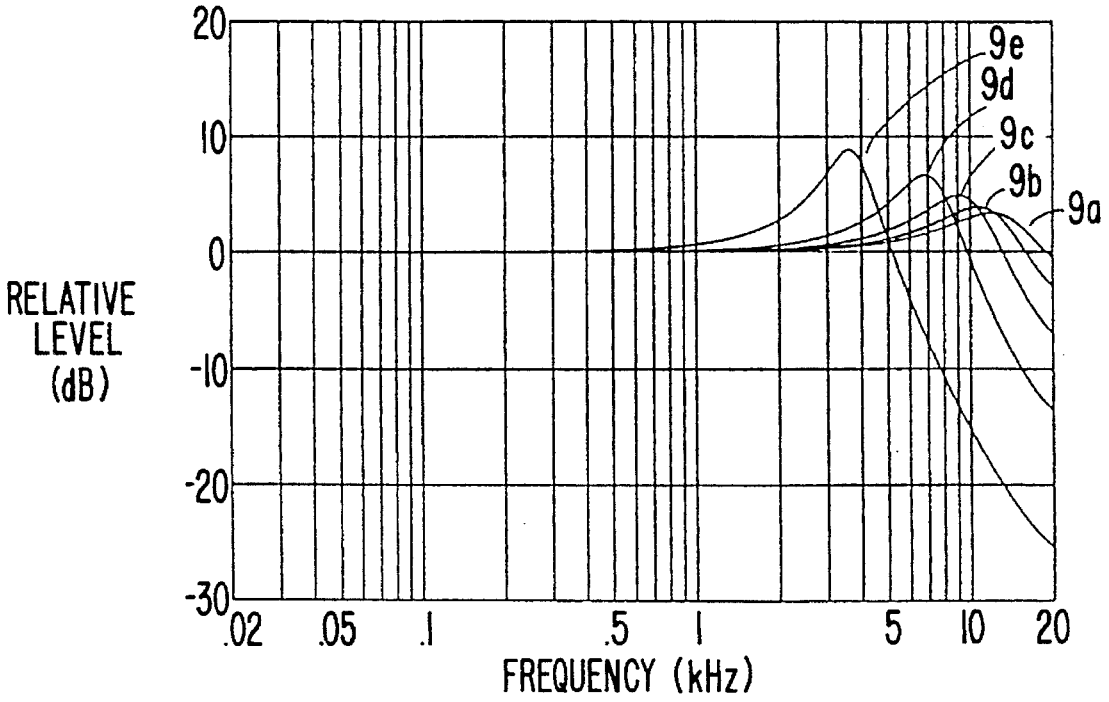
FIG. 9 is a diagram showing a change of the frequency characteristic of the output of the microphone unit dependent on the diameter of the acoustic passage in the system shown in FIG. 7.

The acoustic passage connected to each omni-directional microphone unit adds an acoustic mass to the microphone unit. The addition of the acoustic mass provides the effects of reducing the resonance frequency of the acoustic system, which is the upper frequency limit of the sensitivity to sound pressure, and increasing the resonance Q value. An equivalent circuit of an acoustic system consisting of an omni-directional microphone unit and an acoustic passage coupled to the microphone unit is shown in FIG. 7. In FIG. 7, S denotes the sound source, and Zp denotes the acoustic impedance of the acoustic passage. The part enclosed by a broken line represents the microphone unit, in which M0, C0 and R0 are respectively the acoustic mass, acoustic compliance and acoustic resistance of the diaphragm, and C1 is the acoustic compliance of the rear space in the microphone unit. The frequency characteristic of the output signal of the microphone unit is determined by the mutual relationship between the impedance of the acoustic passage and the impedance of the microphone unit. FIGS. 8 shows a change of the frequency characteristic of the output signal of the microphone unit dependent on the length of the acoustic passage in the system shown in FIG. 7 in a case that a cylindrical passage having a diameter of 2 mm is connected to a cylindrical omni-directional microphone having a diameter of 6 mm, and M0, C0, R0 and C1 are properly set. In FIG. 8, 8*a* show a frequency characteristic when the acoustic passage is not connected to the microphone unit, and 8*b*, 8*c*, 8*d*, 8*e* and 8*f* are frequency characteristics when the length of the acoustic passage connected to the microphone unit is changed to 2 mm, 4 mm, 6 mm, 8 mm and 10 mm, respectively. As seen from FIG. 8, when the length of the acoustic passage is increased, the resonance frequency of the acoustic system decreases and the resonance Q value increases, so that the frequency characteristic is disturbed more largely. FIG. 9 is a diagram showing a change of the frequency characteristic of the output of the microphone unit in the system shown in FIG. 7 in a case that a cylindrical passage having a length of 2 mm is connected to the cylindrical omni-directional microphone having the diameter of 6 mm. In FIG. 9, 9*a*, 9*b*, 9*c*, 9*d*and 9*e* are frequency characteristics when the diameter of the acoustic passage connected to the microphone unit is changed to 2 mm, 1.6 mm, 1.2 mm, 0.8 mm and 0.4 mm, respectively. As seen from FIG. 9, the frequency characteristic is disturbed more as the diameter of the acoustic passage is decreased. In the cases shown in FIGS. 8 and 9, the acoustic passage may be designed to have a length of about 2 mm and a diameter of about 2 mm to produce a practically usable microphone. As described above, the acoustic passage connected to the microphone may be designed so as not to cause a large disturbance of the frequency characteristic of the output signal of the microphone unit.

A design example of the microphone apparatus shown in FIGS. 1*a* and 1*b* may be such that each of the omni-directional microphone units 12 and 14 has a diameter of 6 mm, each of the acoustic passages 16 and 17 has a length of 2 mm and a diameter of 2 mm, the distance $d_2$ between the centers of the sound inlets 13 and 15 of the microphone units 12 and 14 is 6.1 mm, and the distance $d_1$ between the centers of the open ends of the acoustic passages 16 and 17 is 10 mm.

Figure 2:
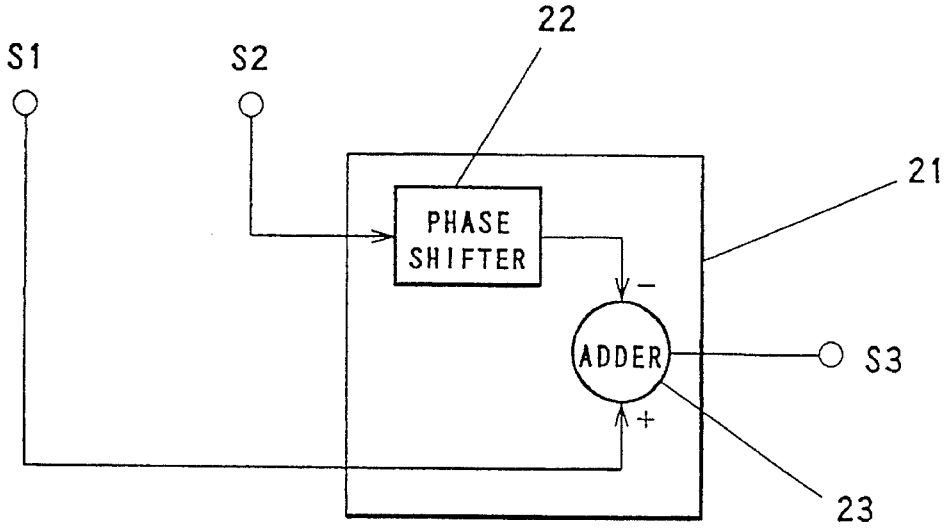
Fig. 2 PRIOR ART
FIG. 2 is a block diagram showing an example of a signal processing circuit used for the microphone apparatus shown in FIGS. 1*a* and 1*b;*

FIG. 2 is a block diagram showing an example of a signal processing circuit used for the microphone apparatus shown in FIGS. 1*a* and 1*b*. Two signals S1 and S2 are respectively the output signals of the omni-directional microphone units 12 and 14 mounted in the unit holders 11*b* and 11*c* if the holder 11*a* shown in FIGS. 1*a* and 1*b*. The signals S1 and S2 are fed to a directivity forming circuit 21 which comprises a phase shifter 22 for phase-shifting the signal S2, and an adder for receiving the signal S1 at its non-inverting (+) terminal and an output signal of the phase shifter 22 at its inverting terminal (−) for adding an inverted form of the output signal of the phase shifter 22 to the signal S1 to produce a sum signal S3.

Figure 3:
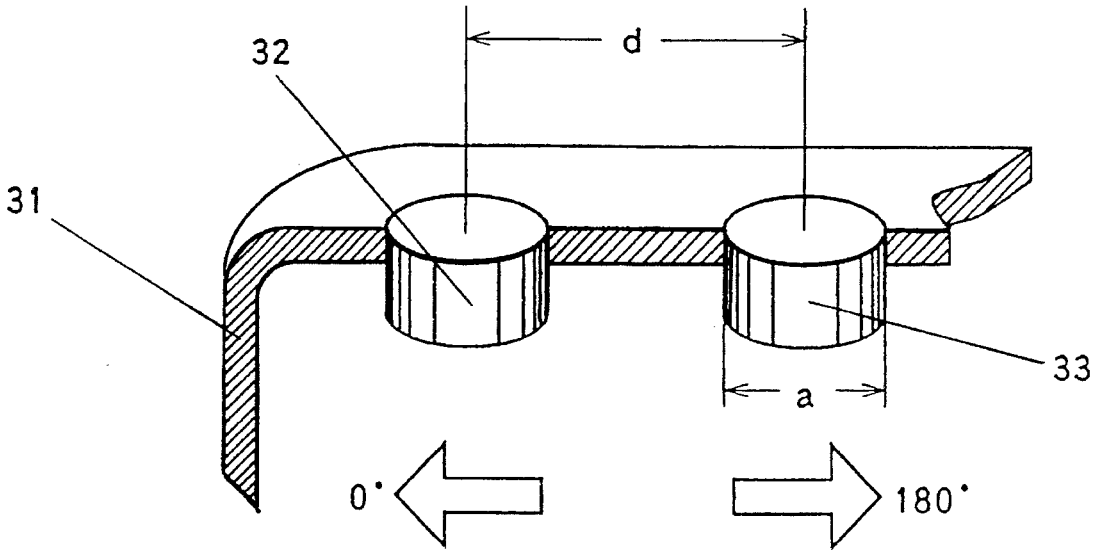
FIG. 3 is a schematic diagram showing an arrangement of two omni-directional microphone units in the conventional pressure gradient type microphone apparatus.

As the result, the microphone apparatus of this embodiment operates as a first-order pressure gradient type microphone apparatus. The operation of a conventional first-order pressure gradient type microphone apparatus will be described for comparison. FIG. 3 is a schematic diagram showing an arrangement of two omni-directional microphone units in the conventional first-order pressure gradient type microphone apparatus. Two omni-directional microphone units 32 and 33 are mounted on a part of the outer wall 31 of the video camera body to be spaced from each other by a center-to-center distance d. The two directions denoted by 0° and 180° respectively represents the front end and rear end directions of the microphone apparatus. Each of the two microphone units 32 and 33 has a diameter a. The length of the area on the outer wall of the video camera body necessary for installing the two microphone units is expressed by d+a at maximum. The output signals of the two microphone units 32 and 33 are processed by the signal processing circuit as shown in FIG. 2. FIG. 4 shows a frequency response of the sensitivity to sound pressure of the conventional first-order pressure gradient type microphone apparatus in the front direction (direction of 0°). The sensitivity to sound pressure becomes maximum at a frequency Fp expressed by Fp=d/2C, where C is the velocity of sound. Usually, sounds are picked up in the frequency range below Fp. The sensitivity to sound pressure is proportional to frequency in the frequency range below Fp. When the distance between the two microphone units 32 and 33 is reduced to be shorter than d, the frequency response curve shifts to the high frequency side as represented by a doted line in FIG. 4. Accordingly, the sensitivity to sound pressure will decrease in the frequency range below Fp.

On the other hand, according to the microphone apparatus shown in FIGS. 1*a* and 1*b*, in which the omni-directional microphone units 12 and 14 are encased within the holder 11*a*, the length on the outer surface of the body of the recording apparatus such as the video camera necessary for installing the microphone apparatus may be $d_1$+t, where t is the diameter of the opening end of each of the acoustic passages 16*b* and 17 coupled to the microphone units, and $d_1$ is equal to d. Accordingly, the microphone apparatus can be reduced in size while substantially maintaining the distance d between the acoustic terminals.

FIG. 5 is a schematic perspective view of a microphone apparatus according to another embodiment of the present invention. A microphone holder 51*a* for holding therein omni-directional microphone units has three unit holders 51*b*, 51*c* and 51*d* for holding three omni-directional microphone units, respectively. The structure of each omni-directional microphone unit and the internal structure of the holder are basically the same as those in the embodiment shown in FIG. 1*b* although the number of the microphone units and the number of unit holders are increased from two to three. That is, each of the three omni-directional microphone units encased within the microphone holder 51*a* is coupled through an acoustic passage to the outer space of the microphone holder 51*a*. The three omni-directional microphone units are mounted in the microphone holder 51*a* such that the distance between the centers of the sound inlets of each two microphone units is shorter than d. Three acoustic passages are provided in the microphone holder 51*a* such that the distance between the centers of the open ends of each two acoustic passages is d. Accordingly, the microphone apparatus can be reduced in size while maintaining practically required distances between acoustic terminals and thus maintaining a practically required sensitivity to sound pressure.

Figure 6:
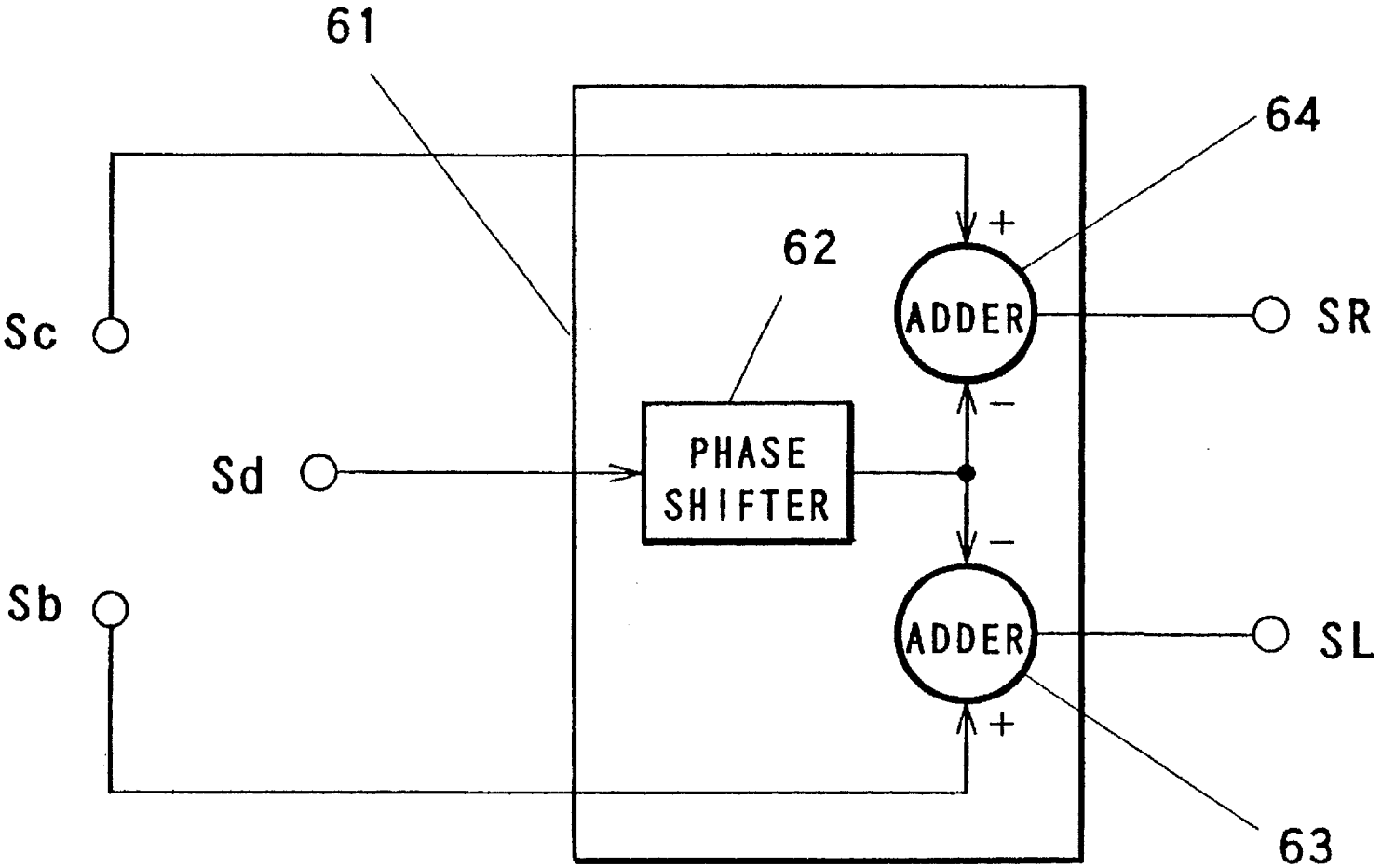
FIG. 6 is a block diagram showing an example of a signal processing circuit used for the microphone apparatus shown in FIG. 5.

FIG. 6 is a block diagram showing an example of a signal processing circuit used for the microphone apparatus shown in FIG. 5. Signals Sb, Sc and Sd are respectively output signals of the three omni-directional microphone units encased and held within the three unit holders 51*b*, 51*c* and 51*d*. A directivity forming circuit 61 for processing the signals Sb, Sc and Sd comprises a phase shifter 62 for phase-shifting the signal Sd, an adder 63 for receiving the signal Sb at its non-inverting terminal (+) and an output signal of the phase shifter 62 at its inverting terminal (−) for adding an inverted form of the output signal of the phase shifter 62 to the signal Sb to obtain a left channel signal $S_L$, and an adder 64 for receiving the signal Sc at its non-inverting terminal (+) and the output signal of the phase shifter 62 at its inverting terminal (−) for adding the inverted form of the output signal of the phase shifter 62 to the signal Sc to obtain a right channel signal $S_R$. Accordingly, the microphone apparatus of this embodiment operates as a stereo microphone apparatus.

What is claimed is:

1. A microphone apparatus comprising:

a plurality of omni-directional microphone units, each of the microphone units having a diaphragm provided perpendicularly to an axial direction of the unit and a sound inlet for exposing therethrough the diaphragm;

a microphone holder for holding therein the plurality of omni-directional microphone units to be arranged in parallel in the axial direction; and a plurality of acoustic passages provided within the microphone holder and having first ends which are respectively coupled to the sound inlets of the plurality of omni-directional microphone units and having second ends which are opened to an outer space of the microphone holder for coupling the sound inlets of the plurality of omni-directional microphone units to the outer space of the microphone holder respectively by the plurality of acoustic passages, the second ends of the acoustic passages being arranged to be apart from each other at distances larger than distances between the sound inlets of the corresponding microphone units coupled at the first ends of the acoustic passages.

2. A microphone apparatus comprising:

first and second omni-directional microphone units, each of the first and second microphone units having a diaphragm provided perpendicularly to an axial direction of the unit and a sound inlet for exposing therethrough the diaphragm;

microphone holder for holding therein the first and second omni-directional microphone units to be arranged in parallel in the axial direction; and first and second acoustic passages provided within the microphone holder and having first ends which are respectively coupled to the sound inlets of the first and second omni-directional microphone units and having second ends which are opened to an outer space of the microphone holder for coupling the sound inlets of the first and second omni-directional microphone units to the outer space of the microphone holder respectively by the first and second acoustic passages, the second ends of the acoustic passages being arranged to be apart from each other at distances larger than distances between the sound inlets of the first and second microphone units coupled at the first ends of the acoustic passages.

3. A microphone apparatus comprising:

first, second and third omni-directional microphone units, each of the first, second and third microphone units having a diaphragm provided perpendicularly to an axial direction of the unit and a sound inlet for exposing therethrough the diaphragm;

microphone holder for holding therein the first, second and third omni-directional and third omni-directional microphone units to be arranged in parallel in the axial direction; and first, second and third acoustic passages provided within the microphone holder and having first ends which are respectively coupled to the sound inlets of the first, second and third omni-directional microphone units and having second ends which are opened to an outer space of the microphone holder for coupling the sound inlets of the first, second and third omni-directional microphone units to the outer space of the microphone holder respectively by the first, second, and third acoustic passages, the second ends of the acoustic passages being arranged to be apart from each other at distances larger than distances between the sound inlets of the first, second and third microphone units coupled at the first ends of the acoustic passages.

* * * * *